US010253526B2

(12) United States Patent
Trent et al.

(10) Patent No.: US 10,253,526 B2
(45) Date of Patent: Apr. 9, 2019

(54) DUAL FUNCTION LOCK CYLINDER ASSEMBLY OPERABLE BY DIFFERENT KEYS

(71) Applicant: ASSA ABLOY High Security Group Inc., Salem, VA (US)

(72) Inventors: Douglas E. Trent, Roanoke, VA (US); James Bench, Roanoke, VA (US); Mark Benzie, Roanoke, VA (US); Lance Schoell, Radford, VA (US)

(73) Assignee: Assa Abloy High Security Group Inc., Salem, VA (US)

( * ) Notice: Subject to any disclaimer, the term of this patent is extended or adjusted under 35 U.S.C. 154(b) by 148 days.

(21) Appl. No.: 15/585,302

(22) Filed: May 3, 2017

(65) Prior Publication Data

US 2017/0321450 A1 Nov. 9, 2017

Related U.S. Application Data

(60) Provisional application No. 62/332,678, filed on May 6, 2016.

(51) Int. Cl.
*E05B 35/10* (2006.01)
*E05B 47/00* (2006.01)
(Continued)

(52) U.S. Cl.
CPC ..... *E05B 35/105* (2013.01); *E05B 9/041* (2013.01); *E05B 17/04* (2013.01); *E05B 17/047* (2013.01); *E05B 27/0003* (2013.01); *E05B 27/0053* (2013.01); *E05B 35/10* (2013.01); *E05B 47/0611* (2013.01); *E05B 2047/0083* (2013.01); *E05B 2047/0084* (2013.01)

(58) Field of Classification Search
CPC ..... E05B 9/041; E05B 17/04; E05B 17/042; E05B 17/047; E05B 2017/043; E05B 27/0053; E05B 35/08; E05B 35/10; E05B 35/105; E05B 35/14; E05B 47/0611; E05B 2047/0083; E05B 2047/0084; E05B 2047/0085
See application file for complete search history.

(56) References Cited

U.S. PATENT DOCUMENTS 474,783 A 5/1892 Taylor
1,233,806 A * 7/1917 Raymond ..... E05B 27/0053 70/337

(Continued)

*Primary Examiner* — Christopher J Boswell
(74) *Attorney, Agent, or Firm* — Rothwell, Figg, Ernst & Manbeck, P.C.

(57) ABSTRACT

A lock cylinder assembly includes a housing, a first cylinder disposed within a first bore formed in the housing, and a second cylinder disposed within a second bore formed in the housing, in which at least one of the first and second cylinders is an electronic cylinder. The lock cylinder assembly further includes first and second cams, in which each of the first and second cams are configured to actuate a door lock mechanism. The first cam is directly connected to the second cylinder so as to be rotatable with the second cylinder. The second cylinder and the second cam are rotatable with respect to each other so that the second cam does not rotate with the second cylinder. The second cam is rotatably coupled to the first cylinder so that the second cam rotates when the first cylinder is rotated.

18 Claims, 6 Drawing Sheets

(51) Int. Cl.

| | |
|---|---|
| ***E05B 27/00*** | (2006.01) |
| ***E05B 9/04*** | (2006.01) |
| ***E05B 47/06*** | (2006.01) |
| ***E05B 17/04*** | (2006.01) |

(56) References Cited

U.S. PATENT DOCUMENTS

| | | | | | |
|---|---|---|---|---|---|
| 1,482,189 | A | * | 1/1924 | Heyer | E05B 27/0053 70/338 |
| 1,947,443 | A | | 2/1934 | Bargman | |
| 2,460,615 | A | | 2/1949 | Andrew | |
| 3,154,938 | A | * | 11/1964 | Cohen | E05B 35/12 70/134 |
| 3,203,210 | A | * | 8/1965 | Check | E05B 35/08 70/340 |
| 3,813,905 | A | * | 6/1974 | Sauder | E05B 35/08 70/339 |
| 3,990,281 | A | * | 11/1976 | Meder | E05B 27/00 70/493 |
| 4,069,694 | A | | 1/1978 | Raymond et al. | |
| 5,265,452 | A | * | 11/1993 | Dawson | E05B 17/042 292/142 |
| 5,372,021 | A | * | 12/1994 | Smith | E05B 35/086 70/389 |
| 6,178,792 | B1 | * | 1/2001 | Glazier | E05B 35/086 70/389 |
| 6,604,394 | B2 | | 8/2003 | Davis | |
| 7,690,231 | B1 | | 4/2010 | Field et al. | |
| 8,122,746 | B2 | | 2/2012 | Hyatt, Jr. | |
| 8,141,399 | B2 | | 3/2012 | Hyatt, Jr. | |
| 8,973,417 | B2 | | 3/2015 | Bench et al. | |
| 8,978,428 | B2 | | 3/2015 | Trent et al. | |

* cited by examiner

DUAL FUNCTION LOCK CYLINDER ASSEMBLY OPERABLE BY DIFFERENT KEYS

CROSS REFERENCE OF RELATED APPLICATION

This application claims the benefit under 35 U.S.C. § 119(e) of the filing date of provisional patent application Ser. No. 62/332,678 filed May 6, 2016, the disclosure of which is incorporated herein by reference in its entirety.

FIELD OF THE DISCLOSURE

This disclosure relates to a lock cylinder assembly that includes a mechanical cylinder and electronic cylinder or two electronic cylinders that are independently operable and which are both interoperable with a door lock mechanism.

BACKGROUND

In commercial building applications (for example, a store front) mechanical lock cylinders, such as mechanical, tumbler-based lock cylinders, are often used to secure the front door. In many such applications, local ordinances require a "backup" or "duplicate" of the mechanical key that operates the door lock to be stored in a protected "box" or "tube" that is accessible, e.g., by emergency personnel, from the outside of the building. Knox Company is a well-known provider of these types of boxes, known as the "Knox Box." The backup mechanical key is used by agencies, such as fire and rescue departments, to gain access to the building in the event of an emergency during off hours or whenever the door is locked. The box storing the backup building key is secured by a different lock that only the emergency agencies have a key to access.

The use of electronic cylinders has become more prevalent in commercial, industrial, and other similar facilities. A typical electronic cylinder comprises an electro-mechanical actuator mounted within the door and configured to selectively lock or unlock a door lock mechanism, such as traditional rim lock or mortise lock hardware application, when activated by a properly programmed electronic key. Such electronic cylinders provide certain advantages that are not available with traditional mechanical cylinders. For example, electronic cylinders can be electronically re-keyed and can be programmed to provide time-based access control to the door to thereby allow access only at certain, predetermined times of day. Electronic cylinders also provide audit information as each electronic key can be programmed to emit a unique signature that is captured by the lock control system when the key is used to access the facility.

When an electronic retrofit cylinder is utilized on a door to control access to a building subject to such ordinances, the mechanical cylinder is replaced with the electronic cylinder, and the mechanical key stored in the protected box is no longer usable to gain access to the door. In this context, the term "retrofit cylinder" means a cylinder having the same physical and operational configuration as an existing cylinder so that it can replace an existing cylinder by fitting into the compartment formed in the door for holding the cylinder lock and it will interoperate with the existing door lock/latch mechanism in the same manner as the replaced cylinder.

In order to meet the requirements of local ordinances for providing access to the front door in the event of an emergency, an electronic key would be need to be stored in the emergency access key box. This is problematic in that an electronic key is typically battery-powered (either replaceable or rechargeable batteries) and it would be necessary to recharge or replace batteries in the electronic key frequently to ensure the key would be operational when needed by the emergency personnel. Additionally, batteries may degrade badly or cease to work in some environments due to the severe temperatures (hot and cold) encountered inside the storage box mounted on the outside of the building.

To avoid these shortcomings, for an electronic cylinder to be practicably usable in a facility subject to such emergency access ordinances, the electronic cylinder should also be operable by a mechanical key that can be stored externally of the facility in an emergency access key box. Unfortunately, a retrofit cylinder that is configured to replace an existing mechanical lock cylinder without requiring a substantial reconfiguration of the door and door latch, and which is operable by a mechanical override key as well as the primary electronic key(s) is not available. Accordingly, there is a need for electronic retrofit cylinder with mechanical override.

In other applications, there are advantages to a retrofit cylinder lock having two electronic cylinders, which are not realized in the application described above with respect to the "Knox Box," where a backup or secondary key is required to be stored in the box for emergency personnel to gain access. In such applications, a retrofit cylinder lock having a second, electronic cylinder option—as opposed to a second, mechanical option—has benefits where the lock cylinder may be utilized. The need to provide independent access to a "shared" asset between two independent management systems is one benefit. Because each electronic cylinder is electronically "unique", each cylinder can be assigned to a different management system. Keys programmed from one system can only access "their" electronic cylinder. The other system can only program keys to access "their" cylinder. Providing access is not dependent on a single party (or system) to provide programming of all keys for access.

An exemplary application is a lock installed on the door of an ATM back room. The ATM service provider can program their key to gain access as needed to gain access to service or repair the ATM. The armored car company needs access to replenish cash in the ATM. They have the ability to program a key from their system to open the door using their cylinder. Neither of these users is dependent on the other for access. In this example, for security purposes, it is better if the service provider does not know when the armored car will be there. The additional benefit over one mechanical and one electronic cylinder is that with two electronic cylinders there is a recorded audit record stored in each cylinder and each key for all accesses. In an application in which one of the cylinders is a mechanical cylinder, there is no audit of the mechanical cylinder being used to access or open the door.

Accordingly, there is also a need for an electronic retrofit cylinder lock that includes two electronic cylinder plugs.

SUMMARY

The following presents a simplified summary in order to provide a basic understanding of some aspects described herein. This summary is not an extensive overview of the claimed subject matter. It is intended to neither identify key or critical elements of the claimed subject matter nor delineate the scope thereof. Its sole purpose is to present some concepts in a simplified form as a prelude to the more detailed description that is presented later.

A proposed solution for a security lock that requires a "backup" key is to provide a dual functioning retrofit cylinder for the door. The dual functioning cylinder would contain two cylinder plugs within the retrofit lock housing that fits into the door, one mechanical plug that is operable by a mechanical key and one electronic plug that is operable by an electronic key. The two cylinders would function independently of each other in this application, but both would be inter-operable with the door lock/latch mechanism (e.g., to retract a bolt) so as to enable access through the door. Under normal usage, the user or occupant of the building would utilize the electronic cylinder plug and gain access to the facility with the corresponding electronic key(s), thereby providing all the of the advantages that electronic key provide. A mechanical key could be used in the event of an emergency to gain access by fire and rescue. The mechanical key would be stored in the storage box that only the emergency agencies have access to, and thus the lock would be incompliance with emergency access ordinances.

The dual functioning retrofit cylinder comprises a double-barrel, double-plug cylindrical lock that is constructed to be of approximately the same size and shape as the traditional, single plug lock cylinders that it replaces, so that the dual-functioning lock may readily be mounted into existing door hardware to replace existing, single-function cylinders. One plug of the lock is a mechanical cylinder configured to be operated by a mechanical key; and the other plug is an electronic cylinder configured to be operated by an electronic key.

A proposed solution for a security lock that allows access to multiple independent management systems is to provide a dual-functioning retrofit cylinder lock that includes two cylinder plugs, which are each operable by an electronic key. In an alternative embodiment, the mechanical cylinder may be replaced with a second electronic cylinder so that dual functioning retrofit cylinder includes two electronic cylinders. The electronic cylinder and the second electronic cylinder function independently of each other so that the dual function cylinder is configured to be operated by two different electronic keys. Accordingly, each electronic cylinder may be assigned to a separate user.

Other features and characteristics of the subject matter of this disclosure, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

The accompanying drawings, which are incorporated herein and form part of the specification, illustrate various embodiments of the subject matter of this disclosure. In the drawings, like reference numbers indicate identical or functionally similar elements.

DETAILED DESCRIPTION

Figure 1:
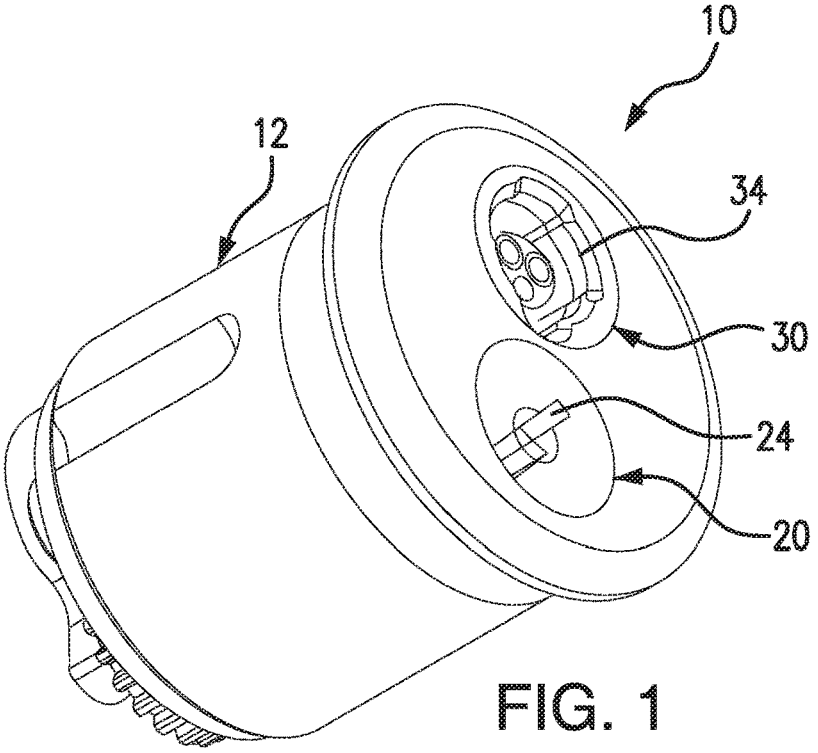
FIG. 1 is a front perspective view of a dual function cylinder assembly.
Figure 2:
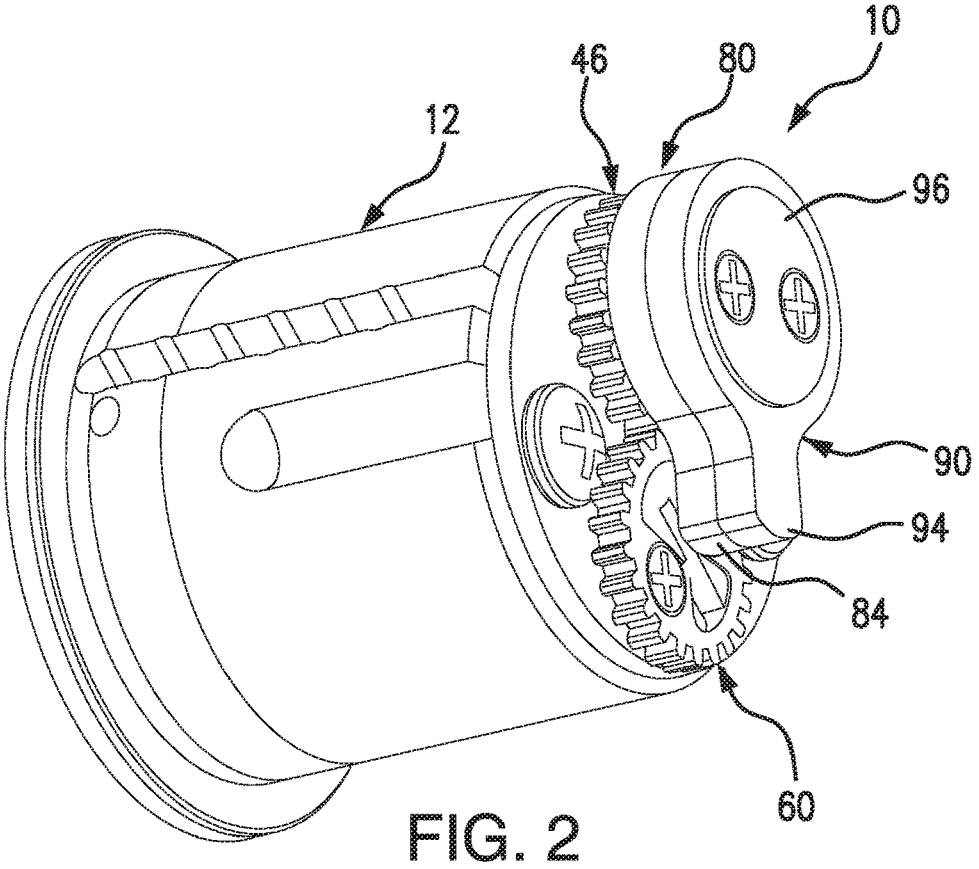
FIG. 2 is a rear perspective view of the dual function cylinder assembly.

While aspects of the subject matter of the present disclosure may be embodied in a variety of forms, the following description and accompanying drawings are merely intended to disclose some of these forms as specific examples of the subject matter. Accordingly, the subject matter of this disclosure is not intended to be limited to the forms or embodiments so described and illustrated.

Unless defined otherwise, all terms of art, notations and other technical terms or terminology used herein have the same meaning as is commonly understood by one of ordinary skill in the art to which this disclosure belongs. All patents, applications, published applications and other publications referred to herein are incorporated by reference in their entirety. If a definition set forth in this section is contrary to or otherwise inconsistent with a definition set forth in the patents, applications, published applications, and other publications that are herein incorporated by reference, the definition set forth in this section prevails over the definition that is incorporated herein by reference.

Unless otherwise indicated or the context suggests otherwise, as used herein, "a" or "an" means "at least one" or "one or more."

This description may use relative spatial and/or orientation terms in describing the position and/or orientation of a component, apparatus, location, feature, or a portion thereof. Unless specifically stated, or otherwise dictated by the context of the description, such terms, including, without limitation, top, bottom, above, below, under, on top of, upper, lower, left of, right of, in front of, behind, next to, adjacent, between, horizontal, vertical, diagonal, longitudinal, transverse, radial, axial, etc., are used for convenience in referring to such component, apparatus, location, feature, or a portion thereof in the drawings and are not intended to be limiting.

Furthermore, unless otherwise stated, any specific dimensions mentioned in this description are merely representative of an exemplary implementation of a device embodying aspects of the disclosure and are not intended to be limiting.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result) in the context of the present disclosure. For example, and not intended to be limiting, this term can be construed as including a deviation of ±10 percent of the given numeric value provided such a deviation does not alter the end function or result of the value. Thus, for example, under some circumstances as would be appreciated by one of ordinary skill in the art a value of "about 1" can be construed to be a range from 0.9 to 1.1.

As used herein, the term "set" refers to a collection of one or more objects. Thus, for example, a set of objects can include a single object or multiple objects. Objects of a set also can be referred to as members of the set. Objects of a set can be the same or different. In some instances, objects of a set can share one or more common properties.

As used herein, the term "adjacent" refers to being near or adjoining. Adjacent objects can be spaced apart from one another or can be in actual or direct contact with one another. In some instances, adjacent objects can be coupled to one another or can be formed integrally with one another.

As used herein, the terms "substantially" and "substantial" refer to a considerable degree or extent. When used in conjunction with an event or circumstance, the terms can refer to instances in which the event or circumstance occurs precisely as well as instances in which the event or circumstance occurs to a close approximation, such as accounting for typical tolerance levels or variability of the embodiments described herein.

As used herein, the terms "optional" and "optionally" mean that the subsequently described event or circumstance may or may not occur and that the description includes instances where the event or circumstance occurs and instances in which it does not.

Figure 3:
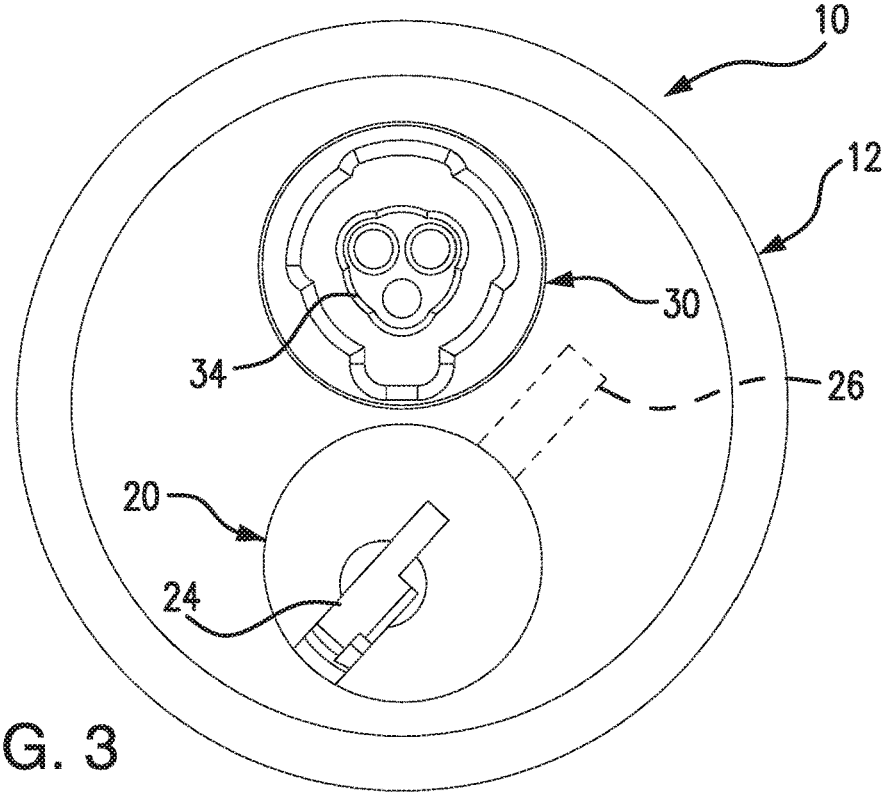
FIG. 3 is a front end view of the dual function cylinder assembly.
Figure 4:
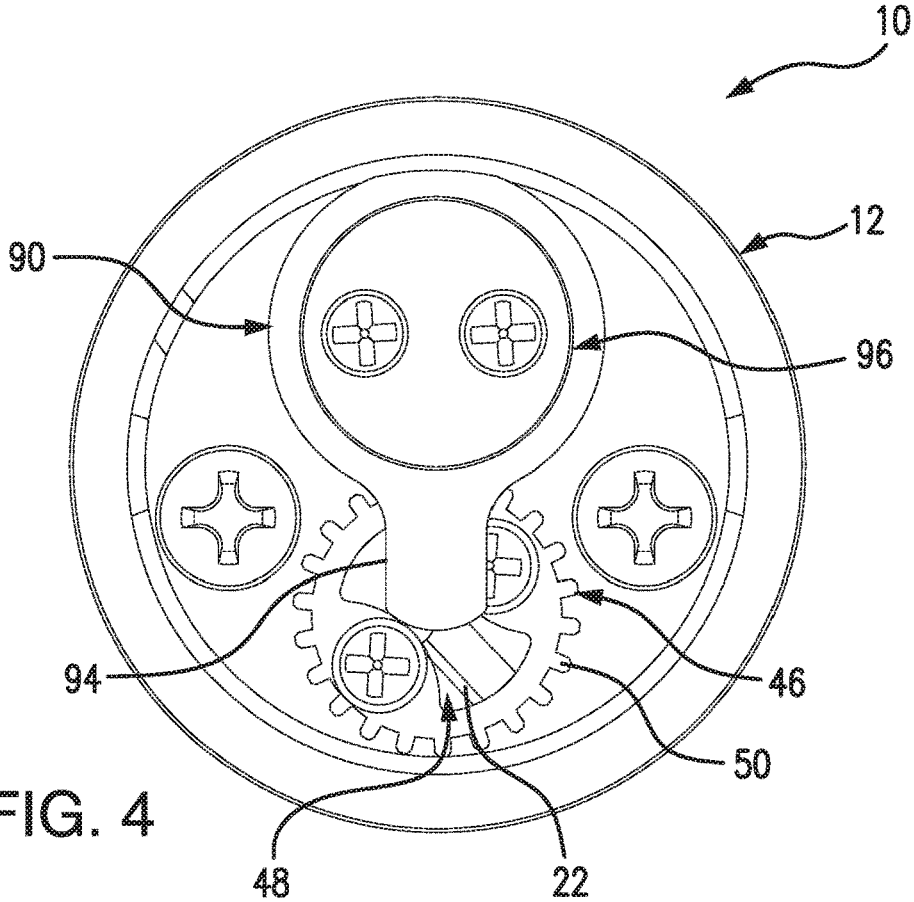
FIG. 4 is a rear end view of the dual function cylinder assembly.

A dual function cylinder assembly according to an embodiment is indicated by reference number 10 in FIGS. 1-7. Referring to FIGS. 1 and 3, the dual function cylinder 10 comprises a housing 12, a mechanical cylinder or plug 20 having a keyhole 24, and an electronic cylinder or plug 30 having a key receptacle 34. The mechanical cylinder 20 may comprise a conventional tumbler cylinder and is arranged within the housing 12 so as to provide a location for one or more tumbler pin assemblies, as indicated at reference number 26 in FIG. 3.

The cylinder 10 is configured to be retrofitted into a compartment formed in a door that is configured to hold a single-function cylinder assembly and is interoperable with any traditional latch mechanism with which the single-function cylinder is operable, such as a traditional rim lock or mortise lock hardware application.

Figure 5:
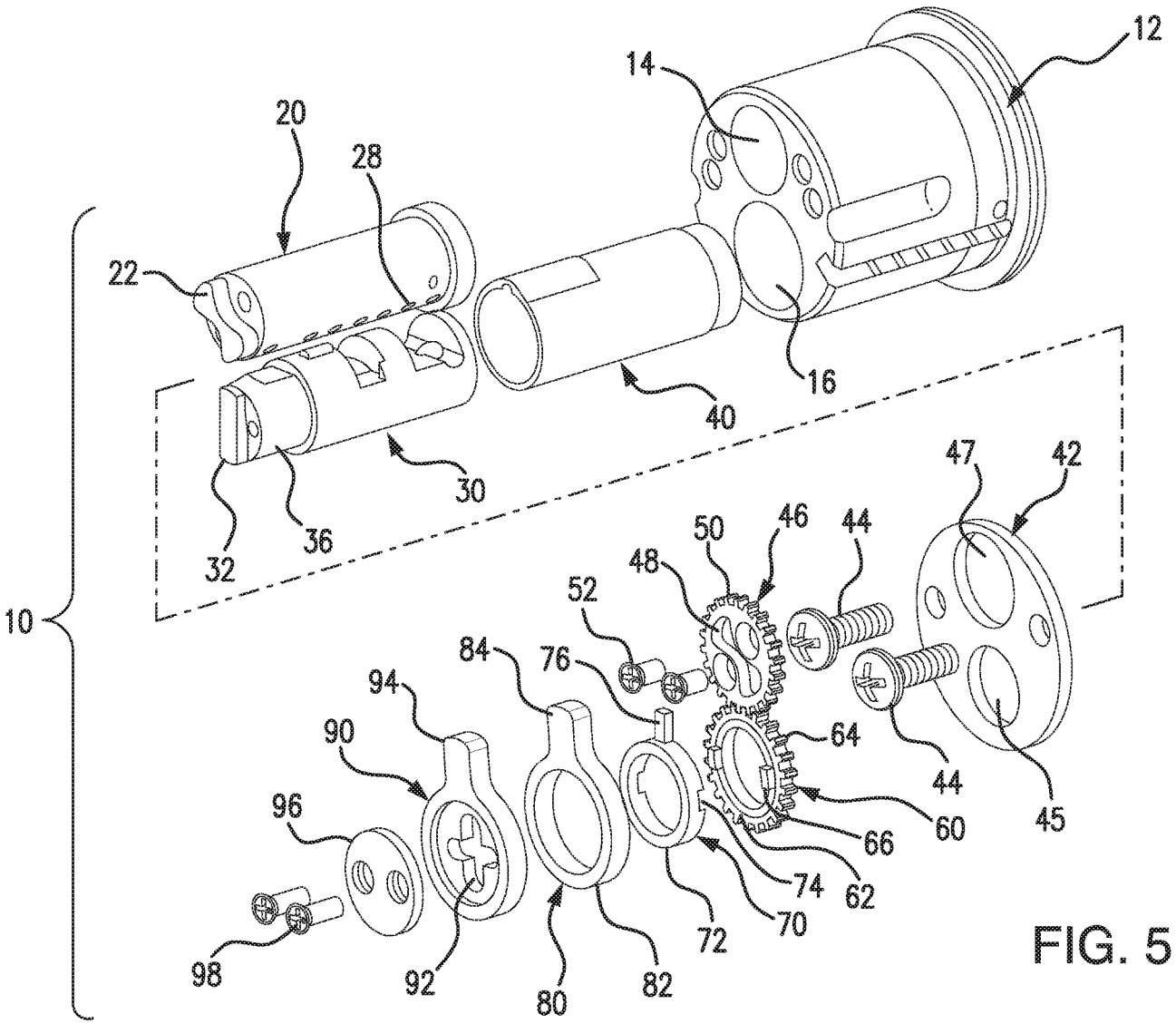
FIG. 5 is an exploded perspective view of the dual function cylinder assembly.

Referring to FIG. 5, the electronic cylinder 30 may be disposed within an electronic cylinder sleeve 40, and the combined assembly is disposed within an electronic cylinder bore 16 formed in the housing 12. Electronic cylinder 30 may comprise any electronically-operable cylinder lock configuration. Exemplary electronic cylinders include Medeco XT electronic cylinders. Aspects of electronic cylinders that may be applicable to cylinder 30 are disclosed in U.S. Pat. Nos. 6,604,394; 7,690,231; 8,973,417, 8,141,399, and 8,122,746 the disclosures of which are hereby incorporated by reference.

The mechanical cylinder 20 is disposed within a mechanical cylinder bore 14 formed in the housing 12. In various embodiments, tumbler holes 26 extending radially from the bore 14 align with tumbler holes 28 formed in the cylinder 20 when the cylinder is in the locked position and accommodate tumbler pin assemblies (not shown) of the cylinder 20.

In various embodiments, the electronic cylinder 30 and the mechanical cylinder 20 are retained within their respective bores 16, 14 by a back plate 42 secured to a back end of the housing 12 by means of screws 44.

The dual function retrofit assembly 10 includes a second cam 80 and a first cam 90. The second cam 80 and the first cam 90 are independently operable as shown in FIGS. 6 and 7 and is each configured to actuate a latch/lock mechanism of a door, such as a rim or mortise lock mechanism.

Figure 6:
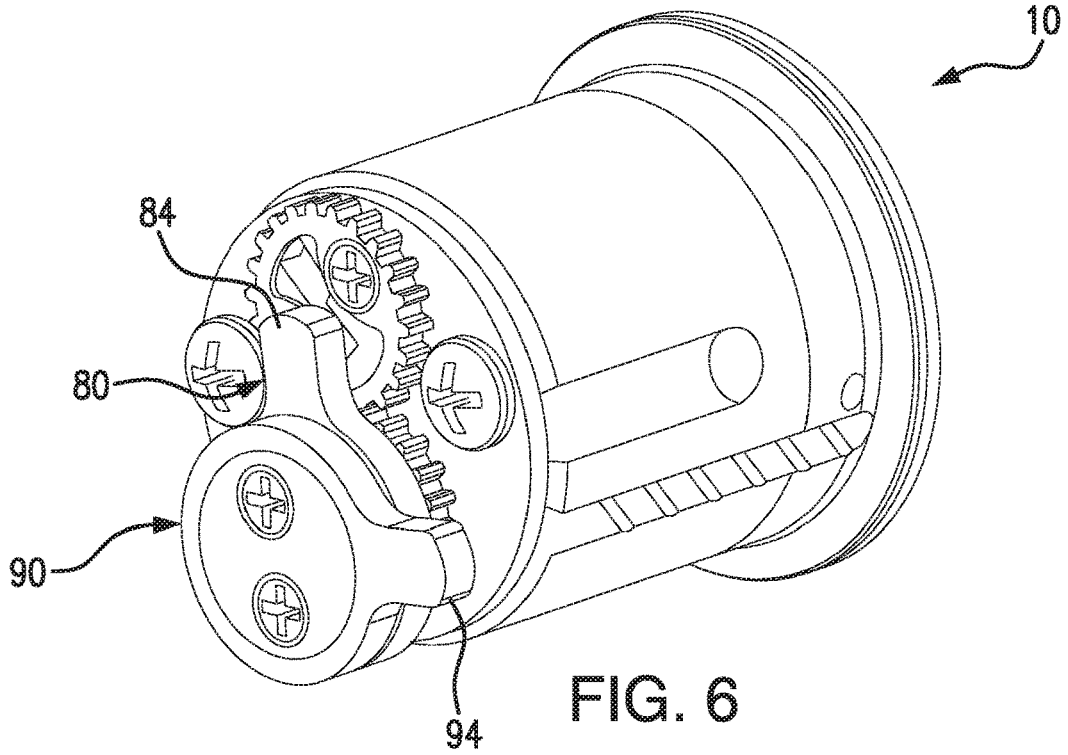
FIG. 6 is a rear perspective view of the dual function cylinder assembly with a first cam thereof rotated to an unlock position and a second cam thereof in a locked position.
Figure 7:
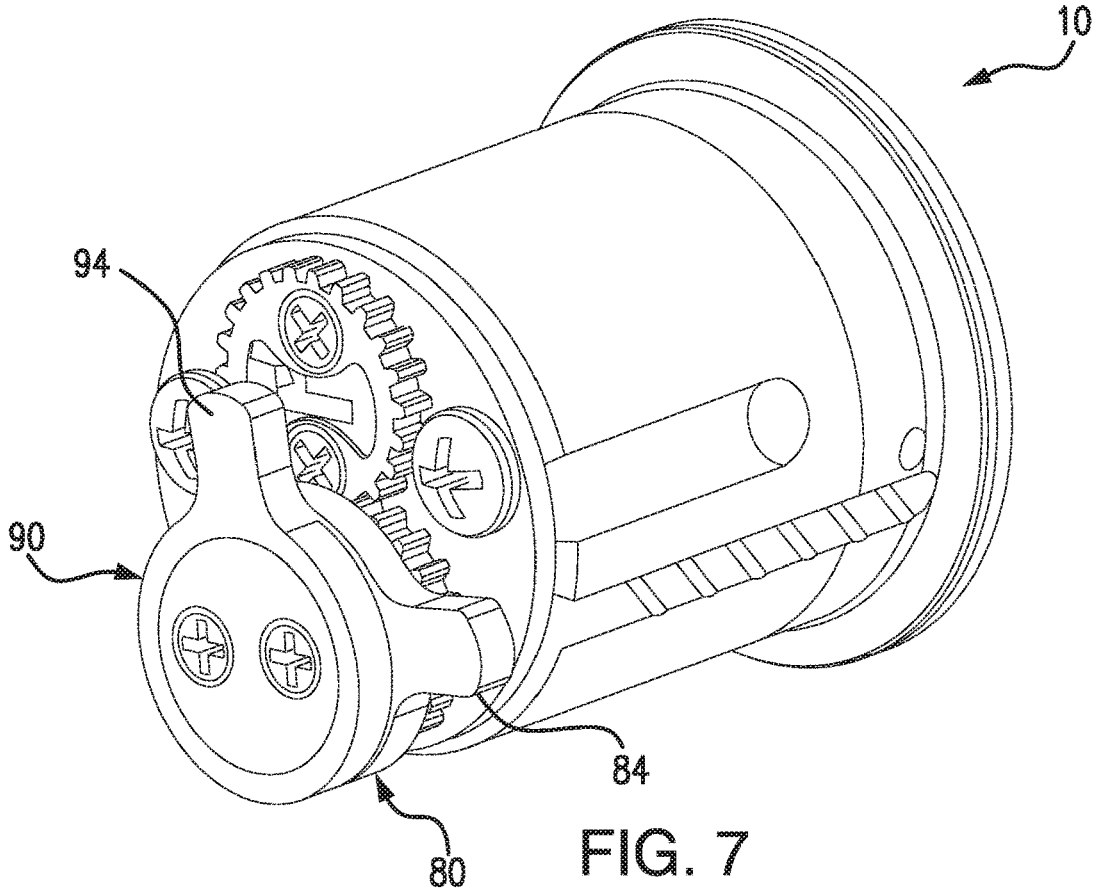
FIG. 7 is a rear perspective view of the dual function cylinder assembly with the first cam in a locked position and the second cam rotated to an unlock position.

FIG. 6 shows the first cam 90 rotated 90° with respect to the second cam 80 so that a tab or arm 84 of the second cam 80 extends upwardly and a tab or arm 94 of the first cam 90 extends to one side. In FIG. 7, the positions of the respective cams are reversed. The tab 94 of the first cam 90 extends upwardly, and the second cam 80 is rotated 90° with respect to the first cam 90 so that the tab 84 extends outwardly.

As shown in FIG. 5, a first drive gear 46 is attached to an end of the mechanical cylinder 20. In one example, a drive tenon 22 extends through an opening 47 formed in the back plate 42 and into an opening 48 formed in the first drive gear 46. The first drive gear 46 may be secured to an end of the mechanical cylinder 20, for example, by screws 52.

The first drive gear 46 includes peripheral teeth 50 that engage with peripheral teeth 64 of a second drive gear 60 that includes a ring 62 rotatably disposed on a cylindrical extension 36 of the electronic cylinder 30 extending through an opening 45 formed in the back plate 42.

A cam driver 70 includes a ring 72 rotatably disposed on the cylindrical extension 36 of the electronic cylinder 30. The second drive gear 60 and the cam driver 70 are coaxially arranged and are rotatably coupled to one another, in the illustrated embodiment, by means of axially-projecting drive tabs 66 extending from the ring 62 of the second drive gear 60 and into axial recesses 74 formed in a ring 72 of the cam driver 70 at diametrically opposed positions.

The second cam 80 includes ring 82 also rotatably disposed on the cylindrical extension 36 of the electronic cylinder 30. In an embodiment, the outside diameter of ring 72 is substantially equal to (or slightly less than) the inside diameter of ring 82 so that ring 72 of the cam driver 70 may fit within the ring 82 of the second cam 80. The second cam 80 and the cam driver 70 are rotatably coupled by a radially-extending drive projection 76 of the cam driver 70 projecting from the ring 72 into a recess (not shown) on a back side of the second cam 80.

In an alternative embodiment, the cam driver 70 is omitted, and the second gear 60 is rotationally coupled to the second cam 80, for example, by the drive tabs 66 extending into complementary recesses formed in the second cam 80. In yet a further alternative, the second gear 60 and the second cam 80 are a single integrated component, or are press-fit together to form a single component.

The first cam 90 is directly connected to the electronic cylinder 30 with a drive tenon 32 projecting axially from the electronic cylinder 30 extending into a star-shaped opening 92 formed in the first cam 90. The first cam 90 may be secured to the electronic cylinder 30 by means of a retainer plate 96 secured by screws 98 extending through a portion of the star-shaped opening 92 into the cylinder 30.

When an appropriate electronic key is inserted into the key receptacle 34 of the electronic cylinder 30 and the electronic cylinder 30 is rotated, the first cam 90 that is directly connected to the cylinder 30 also rotates. The second cam 80, which is rotatably carried on the cylindrical extension 36, is prevented from rotating by means of its rotational coupling to the mechanical cylinder 20 via the second drive gear 60 and the first drive gear 46 that is directly attached to the mechanical cylinder 20. Thus, when the electronic cylinder 30 is rotated to rotate the first cam 90, the cylindrical extension 36 rotates with respect to the second cam 80, the cam driver 70, and the second drive gear 60, all of which are prevented from rotating by means of the first drive gear 46 directly attached to the mechanical cylinder 20.

When an appropriate mechanical key is inserted into the keyhole 24 of the mechanical cylinder 20, and the mechanical cylinder 20 is rotated, the first drive gear 46 is rotated by the mechanical cylinder. Rotation of the first drive gear 46 causes a corresponding rotation of the second drive gear 60, thereby rotating the cam driver 70 and the second cam 80. The second drive gear 60, the cam driver 70 and the second cam 80 all rotate over the cylindrical extension 36 of the electronic cylinder 30, while the first cam 90 is held fixed by means of the electronic cylinder 30.

Figure 8:
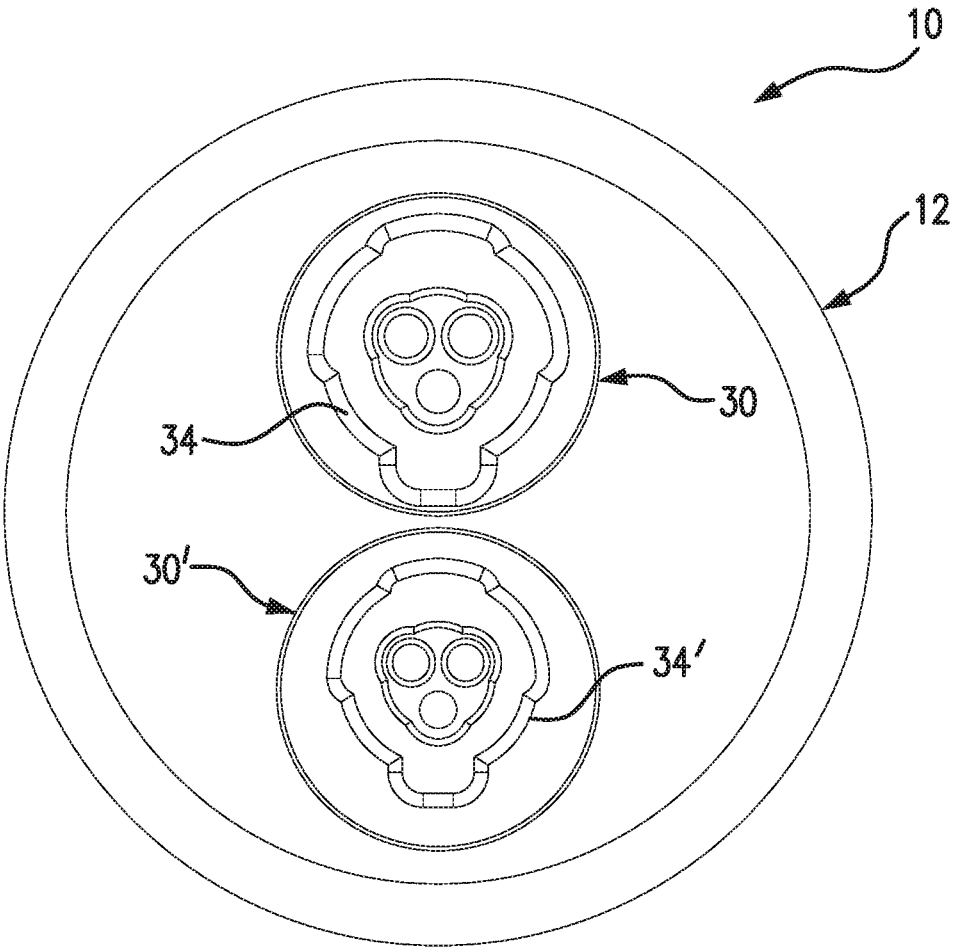
FIG. 8 is a front end view of the dual function cylinder assembly according to an alternative embodiment.
Figure 9:
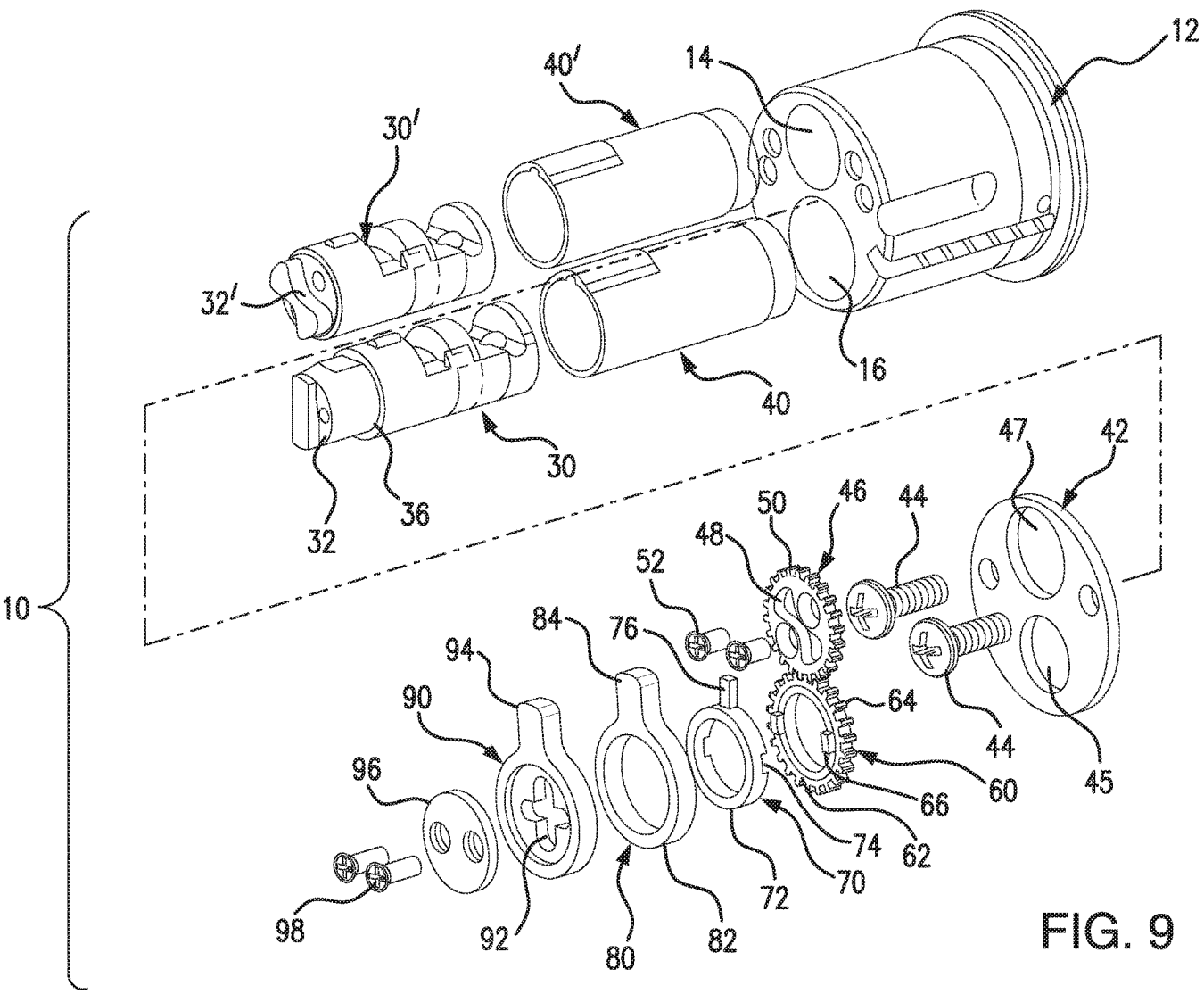
FIG. 9 is an exploded perspective view of a dual function cylinder assembly according to an alternative embodiment.

FIGS. 8 and 9 show an alternative embodiment of the dual function cylinder assembly. This embodiment differs from the dual function cylinder assembly of FIGS. 1-7 in that the mechanical cylinder 20 is replaced with a second electronic cylinder 30' disposed within a second electronic cylinder sleeve 40'. As shown in FIG. 8, the second electronic cylinder 30' includes a second key receptacle 34' so that a second electronic key, rather than a mechanical key, may be used to operate the dual function cylinder assembly. In one embodiment, the profile of the second key receptacle 34' may be shaped differently than the profile of the key receptacle 34 so that a user may easily distinguish the key receptacle 34 from the second key receptacle 34'. By having two separate electronic cylinders or plugs retained within the single housing 12, the dual function cylinder assembly of FIGS. 8 and 9 provides independent access for two different users, in which each user has its own electronic key.

FIG. 9 is an exploded view of the dual function cylinder assembly comprising the electronic cylinder 30 and the second electronic cylinder 30'. Unlike electronic cylinder 30, the second electronic cylinder 30' does not include an extension. Instead, similar to the mechanical cylinder 20, the second electronic cylinder 30' has a drive tenon 32' extending through the opening 47 formed in the back plate 42. The drive tenon 32' extends into the opening 48 of the first drive gear 46, thereby directly attaching the end of the second electronic cylinder 30' to the first drive gear 46. Accordingly, the direct attachment between the second electronic cylinder 30' and the first drive gear 46 prevents the second cam 80, the cam driver 70, and the second drive gear 60 from rotating when the electronic cylinder 30 is rotated by an inserted key. In addition, the direct attachment between the second electronic cylinder 30' and the first drive gear 46 allows the second electronic cylinder 30' to actuate rotation of the first drive gear 46, the second drive gear 60, the cam driver 70, and the second cam 80, while the first cam 90 is held fixed by means of the electronic cylinder 30. Thus, the electronic cylinder 30 and the second electronic cylinder 30' are independently operable.

While the subject matter of this disclosure has been described and shown in considerable detail with reference to certain illustrative embodiments, including various combinations and sub-combinations of features, those skilled in the art will readily appreciate other embodiments and variations and modifications thereof as encompassed within the scope of the present disclosure.

The invention claimed is:

1. A lock cylinder assembly comprising:

a housing;

a mechanical cylinder disposed within a first bore formed in the housing;

an electronic cylinder disposed within a second bore formed in the housing; and first and second cams, each of the first and second cams being configured to actuate a door lock mechanism;

wherein the first cam is directly connected to the electronic cylinder so as to be rotatable with the electronic cylinder and wherein the electronic cylinder and the second cam are rotatable with respect to each other so that the second cam does not rotate with the electronic cylinder, and wherein the second cam is rotatably coupled to the mechanical cylinder so that the second cam rotates when the mechanical cylinder is rotated.

2. The lock assembly of claim 1, further comprising:

a first drive gear directly connected to the mechanical cylinder so that the first drive gear rotates with the mechanical cylinder; and a second drive gear rotatably fixed to the second cam and rotationally coupled to the first drive gear, so that rotation of the mechanical cylinder causes a rotation of the first drive gear, which causes a corresponding rotation of the second drive gear and rotation of the second cam.

3. The lock assembly of claim 2, wherein the mechanical cylinder includes a drive tenon extending axially into an opening formed in the first drive gear.

4. The lock assembly of claim 2, wherein the electronic cylinder includes a cylindrical extension, and the second drive gear includes a ring rotatably disposed on the cylindrical extension and the second cam includes a ring rotatably disposed on the cylindrical extension.

5. The lock assembly of claim 4, wherein the electronic cylinder includes a drive tenon extending axially from the cylindrical extension into an opening formed in the first cam.

6. The lock assembly of claim 5, further comprising:

a cam driver having a ring rotatably disposed on the cylindrical extension, wherein the cam driver is rotatably coupled to the second drive gear and the second cam.

7. The lock assembly of claim 6, wherein the second drive gear comprises drive tabs projecting from the ring of the second drive gear, and the drive tabs extend into axial recesses formed in the ring of the cam driver.

8. The lock assembly of claim 6, wherein the cam driver comprises a drive projection projecting from the ring of the cam driver, and the drive projection is received in a recess formed on a back side of the second cam.

9. A lock cylinder assembly comprising:

a housing;

a first cylinder disposed within a first bore formed in the housing;

a second cylinder disposed within a second bore formed in the housing, and wherein at least one of the first and second cylinders is an electronic cylinder; and first and second cams, each of the first and second cams being configured to actuate a door lock mechanism;

wherein the first cam is directly connected to the second cylinder so as to be rotatable with the second cylinder and wherein the second cylinder and the second cam are rotatable with respect to each other so that the second cam does not rotate with the second cylinder, and wherein the second cam is rotatably coupled to the first cylinder so that the second cam rotates when the first cylinder is rotated.

10. The lock assembly of claim 9, wherein the first and second cylinders are each an electronic cylinder.

11. The lock assembly of claim 9, wherein the first cylinder is a mechanical cylinder and the second cylinder is an electronic cylinder.

12. The lock assembly of claim 9, further comprising:

a first drive gear directly connected to the first cylinder so that the first drive gear rotates with the mechanical cylinder; and a second drive gear rotatably fixed to the second cam and rotationally coupled to the first drive gear, so that rotation of the mechanical cylinder causes a rotation of the first drive gear, which causes a corresponding rotation of the second drive gear and rotation of the second cam.

13. The lock assembly of claim 12, wherein the first cylinder includes a drive tenon extending axially into an opening formed in the first drive gear.

14. The lock assembly of claim 12, wherein the second cylinder includes a cylindrical extension, and the second drive gear includes a ring rotatably disposed on the cylindrical extension and the second cam includes a ring rotatably disposed on the cylindrical extension.

15. The lock assembly of claim 14, wherein the second cylinder includes a drive tenon extending from the cylindrical extension and into an opening formed in the first cam.

16. The lock assembly of claim 15, further comprising:

a cam driver having a ring rotatably disposed on the cylindrical extension, wherein the cam driver is rotatably coupled to the second drive gear and the second cam.

17. The lock assembly of claim 16, wherein the second drive gear comprises drive tabs projecting from the ring of the second drive gear, and the drive tabs extend into axial recesses formed in the ring of the cam driver.

18. The lock assembly of claim 16, wherein the cam driver comprises a drive projection projecting from the ring of the cam driver, and the drive projection is received in a recess formed on a back side of the second cam.

* * * * *